US010280936B2

(12) United States Patent
Yoeda

(10) Patent No.: US 10,280,936 B2
(45) Date of Patent: May 7, 2019

(54) COMPRESSOR FOR SUPERCHARGER OF INTERNAL COMBUSTION ENGINE

(75) Inventor: Keiji Yoeda, Numazu (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 609 days.

(21) Appl. No.: 14/412,719

(22) PCT Filed: Jul. 6, 2012

(86) PCT No.: PCT/JP2012/067368

§ 371 (c)(1),
(2), (4) Date: Jan. 5, 2015

(87) PCT Pub. No.: WO2014/006751

PCT Pub. Date: Jan. 9, 2014

(65) Prior Publication Data

US 2015/0132120 A1 May 14, 2015

(51) Int. Cl.

| | |
|---|---|
| ***F04D 29/44*** | (2006.01) |
| ***F04D 29/42*** | (2006.01) |
| ***F04D 17/10*** | (2006.01) |
| ***F01D 9/02*** | (2006.01) |
| *F04D 29/28* | (2006.01) |
| *F01D 17/14* | (2006.01) |
| *F02B 39/00* | (2006.01) |

(52) U.S. Cl.

CPC ..... *F04D 29/422* (2013.01); *F01D 9/026* (2013.01); *F04D 17/10* (2013.01); *F04D 29/441* (2013.01); *F01D 17/143* (2013.01); *F02B 39/00* (2013.01); *F04D 29/284* (2013.01); *F04D 29/444* (2013.01); *F05D 2220/40* (2013.01); *F05D 2250/314* (2013.01); *F05D 2250/52* (2013.01)

(58) Field of Classification Search

CPC ..... F04D 29/44; F04D 29/441; F04D 29/444
See application file for complete search history.

(56) References Cited

U.S. PATENT DOCUMENTS

| | | | | |
|---|---|---|---|---|
| 5,228,832 | A | 7/1993 | Nishida et al. | |
| 6,168,375 | B1 | 1/2001 | LaRue et al. | |
| 2010/0129209 | A1* | 5/2010 | Sugimoto | F04D 29/441 415/203 |
| 2010/0202877 | A1* | 8/2010 | Sweetland | F01D 9/026 415/204 |

(Continued)

FOREIGN PATENT DOCUMENTS

| | | | |
|---|---|---|---|
| EP | 2221487 | A1 | 8/2010 |
| JP | 3264796 | B2 | 11/1991 |
| JP | H11-182257 | A | 7/1999 |

(Continued)

*Primary Examiner* — Justin Seabe
*Assistant Examiner* — Behnoush Haghighian
(74) *Attorney, Agent, or Firm* — Hunton Andrews Kurth LLP

(57) ABSTRACT

In a compressor for a supercharger of an internal combustion engine comprising a shroud, an impeller, a vaneless diffuser, and a scroll, a hub-side wall of the vaneless diffuser is formed to be inclined to the opposite side to a shroud-side wall with respect to a direction perpendicular to a rotational axis of the impeller in the longitudinal cross section including the rotational axis of the impeller. With such a configuration, the amount of deposit formed on the hub-side wall of the vaneless diffuser is reduced.

4 Claims, 8 Drawing Sheets

(56) References Cited

U.S. PATENT DOCUMENTS

| | | | | |
|---|---|---|---|---|
| 2011/0002780 | A1 | 1/2011 | Higashimori | |
| 2014/0369823 | A1* | 12/2014 | Yamashita | F04D 29/284 415/203 |

FOREIGN PATENT DOCUMENTS

| | | | |
|---|---|---|---|
| JP | 2003-526037 | A | 9/2003 |
| JP | 2008-075536 | A | 4/2008 |
| JP | 2008-175124 | A | 7/2008 |
| JP | 2009-150245 | A | 7/2009 |
| JP | 3168894 | U | 7/2011 |
| WO | 2009003140 | A2 | 12/2008 |

* cited by examiner

COMPRESSOR FOR SUPERCHARGER OF INTERNAL COMBUSTION ENGINE

CROSS-REFERENCE TO RELATED APPLICATION

This is a national phase application based on the PCT International Patent Application No. PCT/JP2012/067368 filed Jul. 6, 2012, the entire contents of which are incorporated herein by reference.

TECHNICAL FIELD

The present invention relates to a compressor for a supercharger of an internal combustion engine and, in particular, to a centrifugal compressor suitably used in a turbocharger.

BACKGROUND ART

A conventional centrifugal compressor is known as means for compressing air. The patent literatures listed later disclose inventions relating to centrifugal compressors. A centrifugal compressor is used in a supercharger of an internal combustion engine, in particular, a turbocharger.

A typical conventional supercharger of an internal combustion engine uses a compressor configured as shown in FIG. 14. The compressor has an outer shell, which is formed by a housing 102 and a back plate 106. The back plate 106 is fixed to a bearing housing (not shown), and the back plate 106 and the housing 102 are fastened to each other with a bolt.

A shroud 104 is formed in the housing 102, and an impeller 110 is housed in the shroud 104. The impeller 110 has a hub 112 supported by a bearing (not shown) so as to be rotatable about a rotational axis CL, and a plurality of blades 114 attached to a surface of the hub 112.

An annular diffuser 120 is provided around the periphery of the impeller 110 so as to surround the impeller 110. The diffuser 120 is formed by a shroud-side wall 124, which is a part of the housing 102, and a hub-side wall 122, which is a part of the back plate 106. The shroud-side wall 124 is seamlessly connected to a surface of the shroud 104, and the hub-side wall 122 is connected to the surface of the hub 112 via a step formed by the outer edge of the hub 112. With the compressor of the typical conventional supercharger, the shroud-side wall 124 and the hub-side wall 122 are each formed as a flat surface perpendicular to the rotational axis CL of the impeller 110. Although the diffuser 120 illustrated in FIG. 14 is a vaneless diffuser, which has no vane, the supercharger of the typical conventional internal combustion engine may use a compressor provided with a vane diffuser, which has a vane.

In the housing 102, a spiral scroll 130 is provided around the periphery of the diffuser 120 so as to surround the diffuser 120. Air taken in by the compressor is accelerated by the rotating impeller 110 and then decelerated by the diffuser 120 and thereby compressed. The compressed air flowing from all around the perimeter of the diffuser 120 is collected by the scroll 130, and the resulting one flow of air is fed to a downstream inlet pipe.

A problem with the internal combustion engine provided with a supercharger is deposit on the inner wall of the compressor. The deposit grows from oil mist contained in blow-by gas. With the internal combustion engine for a vehicle, the blow-by gas leaking from the combustion chamber to the crankcase is fed back to the inlet channel and processed there. In the case of the internal combustion engine provided with a supercharger, the blow-by gas is fed back to upstream of the compressor in the inlet channel. The oil mist in the blow-by gas contains carbon soot resulting from combustion of fuel, and the oil mist adhering to the wall of the compressor is increased in viscosity and turned into deposit in the high temperature atmosphere. The deposit in the compressor decreases the efficiency of the compressor and therefore degrades the performance of the internal combustion engine.

With the conventional compressor configured as shown in FIG. 14, in particular, deposit on the hub-side wall 122 of the diffuser 120 poses a problem. FIG. 15 schematically shows a flow of oil mist in the diffuser 120 of the conventional compressor. The oil mist is conveyed by the flow of compressed air ejected from the impeller 110 in a direction that is not in parallel with the walls 122 and 124 of the diffuser 120. In the longitudinal cross section including the rotational axis CL of the impeller 110, the walls 122 and 124 of the diffuser 120 are in parallel with a line L1 that is perpendicular to the rotational axis CL of the impeller. Since the compressed air ejected from the impeller 110 still partially flows in the axial direction, however, the direction of the flow of the oil mist is inclined toward the hub-side wall 122 from the perpendicular line L1. As a result, a large amount of oil mist collides with and adheres to the hub-side wall 122. The oil mist has a high surface area to volume ratio and therefore quickly evaporates, so that the oil mist is increased in viscosity immediately after the oil mist adheres to the hub-side wall 122, and is turned into deposit on the hub-side wall 122.

To the contrary, less deposit is formed on the shroud-side wall 124. This is because a smaller amount of oil mist adheres to the shroud-side wall 124 due to the direction of the flow, and oil flowing to the shroud-side wall 124 along the surface of the shroud 104 prevents growth of the deposit on the shroud-side wall 124. From these considerations, it can be said that it is important to reduce the amount of deposit on the walls of the diffuser, in particular, the hub-side wall, in order to reduce the amount of deposit in the compressor and maintain the efficiency of the compressor.

CITATION LIST

Patent Literature

Patent Literature 1: Japanese Patent Laid-Open No. 2009-150245

Patent Literature 2: Japanese Utility Model Registration No. 3168894

Patent Literature 3: Japanese Patent Laid-Open No. 11-182257

SUMMARY OF INVENTION

An object of the present invention is to reduce the amount of deposit on a wall of a diffuser, in particular, a hub-side wall of the diffuser, in a compressor for a supercharger of an internal combustion engine.

The present invention can be applied to a compressor comprising a shroud formed inside a housing, an impeller having a hub rotatably disposed in the shroud and a plurality of blades attached to a surface of the hub, an annular vaneless diffuser that surrounds a periphery of the impeller, and a spiral scroll that surrounds a periphery of the vaneless diffuser. In such an application to a compressor, the above-described object is attained by a hub-side wall of the vaneless diffuser being formed to be inclined to an opposite side to a shroud-side wall with respect to a direction perpendicular to a rotational axis of the impeller in a longitudinal cross section including the rotational axis of the impeller.

Since the hub-side wall of the vaneless diffuser is formed in this way, the possibility that oil mist conveyed by the flow of the compressed air ejected from the impeller collides with and adheres to the hub-side wall is decreased.

According to the present invention, preferably, in the longitudinal cross section including the rotational axis of the impeller, the hub-side wall of the vaneless diffuser is formed to be in parallel with a direction of a flow of gas ejected from the impeller or to be inclined to the opposite side to the shroud-side wall or to be inclined to the opposite side to the shroud-side wall with respect to a direction of a tangential line to a surface of an outlet of the hub. Preferably, the hub-side wall of the vaneless diffuser is formed to have the shape of a truncated conical surface.

Preferably, the shroud-side wall of the vaneless diffuser is formed to be inclined toward the hub-side wall with respect to the direction perpendicular to the rotational axis of the impeller in the longitudinal cross section including the rotational axis of the impeller. According to the present invention, preferably, in the longitudinal cross section including the rotational axis of the impeller, the shroud-side wall of the vaneless diffuser is formed to be in parallel with the direction of the flow of gas ejected from the impeller or to be inclined toward to the hub-side wall, or formed to be inclined toward the hub-side wall with respect to the direction of the tangential line to the surface of the outlet of the hub. Preferably, the shroud-side wall of the vaneless diffuser is also formed to have the shape of a truncated conical surface.

In addition, the present invention can be applied to a compressor comprising a shroud formed inside a housing, an impeller having a hub rotatably disposed in the shroud and a plurality of blades attached to a surface of the hub, an annular diffuser that surrounds a periphery of the impeller, and a spiral scroll that surrounds a periphery of the diffuser. The "diffuser" referred to herein means both the vaneless diffuser and the vane diffuser. In such an application to a compressor, the above-described object is achieved by a hub-side wall of the diffuser being formed to be inclined to an opposite side to a shroud-side wall with respect to a direction perpendicular to a rotational axis of the impeller in a longitudinal cross section including the rotational axis of the impeller, and the shroud-side wall of the diffuser being formed to be inclined toward the hub-side wall with respect to the direction perpendicular to the rotational axis of the impeller.

Since the hub-side wall and the shroud-side wall of the diffuser are formed in this way, the possibility that oil mist conveyed by the flow of the compressed air ejected from the impeller collides with and adheres to the hub-side wall is decreased, and instead the oil mist collides with the shroud-side wall. Since oil flows to the shroud-side wall along the surface of the shroud, the oil mist colliding with the shroud-side wall is washed out by the oil. Therefore, even if the amount of oil mist colliding with the shroud-side wall increases, no deposit grows on the shroud-side wall, or any deposit on the shroud-side wall grows at a very slow rate.

According to the present invention, preferably, in the longitudinal cross section including the rotational axis of the impeller, the hub-side wall of the diffuser is formed to be in parallel with a direction of a flow of gas ejected from the impeller or to be inclined to the opposite side to the shroud-side wall or to be inclined to the opposite side to the shroud-side wall with respect to a direction of a tangential line to a surface of an outlet of the hub. In addition, according to the present invention, preferably, in the longitudinal cross section including the rotational axis of the impeller, the shroud-side wall of the diffuser is formed to be in parallel with the direction of the flow of gas ejected from the impeller or to be inclined toward to the hub-side wall, or formed to be inclined toward the hub-side wall with respect to the direction of the tangential line to the surface of the outlet of the hub. Preferably, at least one of the hub-side wall and the shroud-side wall of the diffuser is formed to have the shape of a truncated conical surface.

DESCRIPTION OF EMBODIMENTS

Embodiment 1

In the following, an embodiment 1 of the present invention will be described with reference to the drawings.

Figure 1:
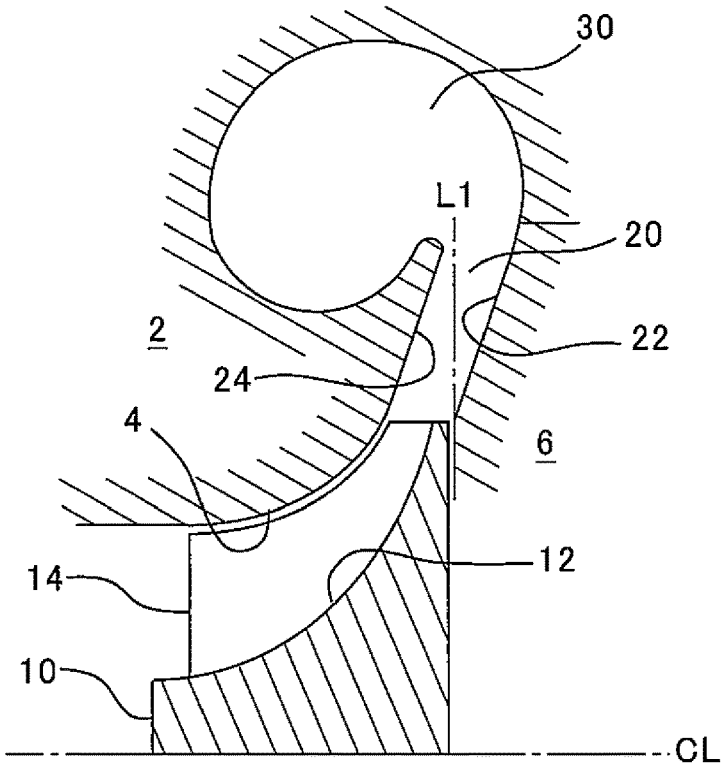
FIG. 1 is a longitudinal cross-sectional view showing a configuration of a compressor for a supercharger of an internal combustion engine according to an embodiment 1 of the present invention.

FIG. 1 is a longitudinal cross-sectional view showing a configuration of a compressor for a supercharger of an internal combustion engine according to the embodiment 1 of the present invention. The compressor according to this embodiment has an outer shell, which is formed by a housing 2 and a back plate 6. The back plate 6 is fixed to a bearing housing (not shown), and the back plate 6 and the housing 2 are fastened to each other with a bolt.

A shroud 4 is formed in the housing 2, and an impeller 10 is housed in the shroud 4. The impeller 10 has a hub 12 supported by a bearing (not shown) so as to be rotatable about a rotational axis CL, and a plurality of blades 14 attached to a surface of the hub 12.

An annular vaneless diffuser 20 is provided around the periphery of the impeller 10 so as to surround the impeller 10. The vaneless diffuser 20 is formed by a shroud-side wall 24, which is a part of the housing 2, and a hub-side wall 22, which is a part of the back plate 6. The shroud-side wall 24 is seamlessly connected to a surface of the shroud 4, and the hub-side wall 22 is connected to the surface of the hub 12 via a step formed by the outer edge of the hub 12. The configuration of the vaneless diffuser 20 will be described in detail later.

In the housing 2, a spiral scroll 30 is provided around the periphery of the vaneless diffuser 20 so as to surround the vaneless diffuser 20. Air taken in by the compressor is accelerated by the rotating impeller 10 and then decelerated by the vaneless diffuser 20 and thereby compressed. The compressed air flowing from all around the perimeter of the vaneless diffuser 20 is collected by the scroll 30, and the resulting one flow of air is fed to a downstream inlet pipe.

Figure 2:
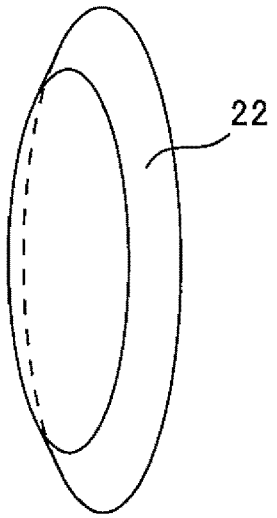
FIG. 2 is a perspective view showing the shape of a hub-side wall of a diffuser according to the embodiment 1 of the present invention.

In this embodiment, in the longitudinal cross section including the rotational axis CL of the impeller 10, the hub-side wall 22 of the vaneless diffuser 20 is formed to be inclined toward the opposite side to the shroud-side wall 24 with respect to a line L1 that is perpendicular to the rotational axis CL of the impeller 10. FIG. 2 is a perspective view showing the shape of the hub-side wall 22. As shown in the drawing, the hub-side wall 22 has the shape of a truncated conical surface, more specifically, the shape of an outer peripheral surface of a truncated cone.

In the longitudinal cross section including the rotational axis CL of the impeller 10, the shroud-side wall 24 is formed to be inclined toward the hub-side wall 22 with respect to the line L1 that is perpendicular to the rotational axis CL of the impeller 10. Although not shown in a perspective view, the shroud-side wall 24 has the shape of a truncated conical surface, more specifically, the shape of an inner peripheral surface of a conical cone. In this embodiment, the distance between the shroud-side wall 24 and the hub-side wall 22 is constant from the inlet to the outlet of the vaneless diffuser 20.

Figure 3:
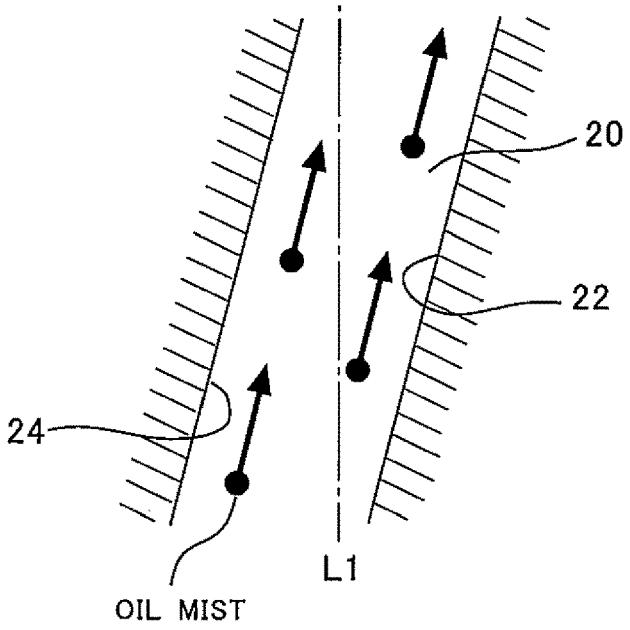
FIG. 3 is a diagram for illustrating a flow of oil mist in a vaneless diffuser of the compressor according to the embodiment 1 of the present invention.
Figure 4:
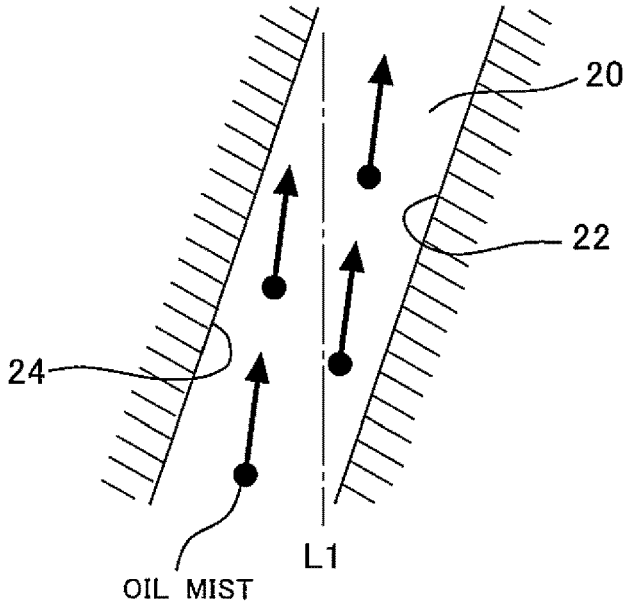
FIG. 4 is a diagram for illustrating a flow of oil mist in the vaneless diffuser of the compressor according to the embodiment 1 of the present invention.

FIGS. 3 and 4 schematically show flows of oil mist in the diffuser 20 in the compressor according to this embodiment. The compressed air ejected from the impeller 10 still partially flows in the axial direction, so that the direction of the flow of the oil mist is inclined toward the hub-side wall 22 from the perpendicular line L1. With the compressor according to this embodiment however, the hub-side wall 22 is also formed to be inclined to the opposite side to the shroud-side wall 24 with respect to the perpendicular line L1, and therefore, the possibility that the oil mist conveyed by the compressed air ejected from the impeller 10 collides with and adheres to the hub-side wall 22 is decreased. More specifically, as shown in FIG. 3, most of the oil mist flies in parallel with the walls 22 and 24 of the diffuser 20 and reaches the scroll 30 by passing through between the walls 22 and 24. In another scenario, as shown in FIG. 4, most of the oil mist flies toward the shroud-side wall 24 and collides with the shroud-side wall 24.

As can be seen from the above description, with the configuration of the compressor according to this embodiment, the amount of deposit on the walls of the vaneless diffuser 20, in particular, the hub-side wall 22 of the vaneless diffuser 20 can be reduced. Note that, since oil flows to the shroud-side wall 24 of the vaneless diffuser 20 along the surface of the shroud 4, the oil mist colliding with the shroud-side wall 24 is washed out by the oil. Therefore, even if the amount of oil mist colliding with the shroud-side wall 24 increases as in the case shown in FIG. 4, no deposit grows on the shroud-side wall 24, or any deposit on the shroud-side wall 24 grows at a very slow rate. Therefore, with the configuration of the compressor according to this embodiment, the amount of deposit of the entire vaneless diffuser 20 can be reduced.

The supercharger provided with the compressor according to this embodiment or the compressor according to any of the embodiments 2 to 7 described below is preferably a turbocharger that drives a turbine that rotates integrally with the compressor with the energy of exhaust gas. Alternatively, however, the supercharger may be a mechanical supercharger that makes the compressor rotates with a torque from the crankshaft of the internal combustion engine. The internal combustion engine provides with such a supercharger may be a diesel engine or a spark ignition engine.

Embodiment 2

Next, an embodiment 2 of the present invention will be described with reference to the drawings.

A compressor for a supercharger of an internal combustion engine according to the embodiment 2 of the present invention has basically the same configuration as the compressor according to the embodiment 1 and differs from the compressor according to the embodiment 1 only in limitations concerning the shape of the vaneless diffuser. This holds true for the compressors according to the embodiments 3 to 6 described later.

Figure 5:
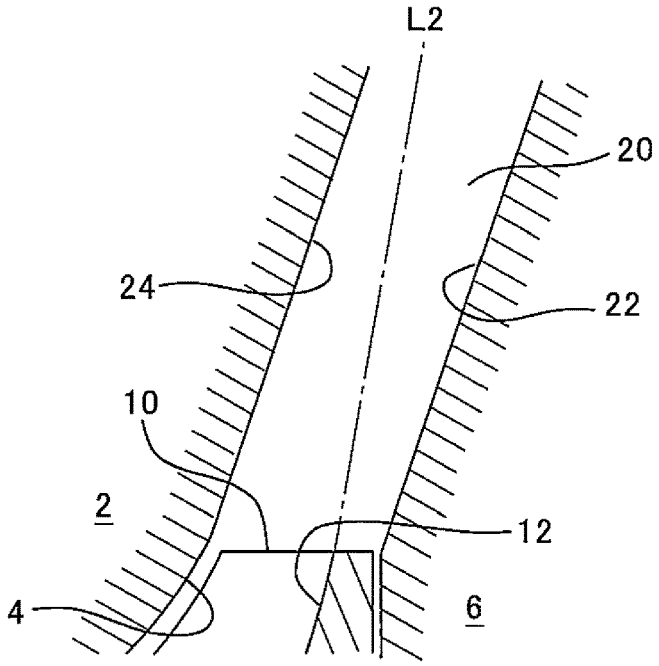
FIG. 5 is a longitudinal cross-sectional view showing essential parts of a vaneless diffuser configured according to an embodiment 2.

FIG. 5 is a longitudinal cross-sectional view showing essential parts of the vaneless diffuser configured according to this embodiment. In this embodiment, in the longitudinal cross section including the rotational axis of the impeller 10, the hub-side wall 22 of the vaneless diffuser 20 is formed to be inclined to the opposite side to the shroud-side wall 24 with respect to a tangential line L2 to the surface of an outlet of the hub 12. In the longitudinal cross section including the rotational axis of the impeller 10, the shroud-side wall 24 is formed to be inclined toward the hub-side wall 22 with respect to the tangential line L2 to the surface of the outlet of the hub 12. The distance between the shroud-side wall 24 and the hub-side wall 22 is constant from the inlet to the outlet of the vaneless diffuser 20.

In the longitudinal cross section including the rotational axis of the impeller 10, the direction of the compressed air ejected from the impeller 10 is close to the direction of the tangential line L2 to the surface of the outlet of the hub 12. Since the hub-side wall 22 of the vaneless diffuser 20 is formed as described above, the possibility that the oil mist conveyed by the flow of the compressed air ejected from the impeller 10 collides with and adheres to the hub-side wall 22 is decreased with higher reliability. In addition, since the shroud-side wall 24 of the vaneless diffuser 20 is formed as described above, the oil mist is washed out with higher reliability by the oil that collides with the shroud-side wall 24 and flows on the surface of the shroud 4.

Embodiment 3

Next, an embodiment 3 of the present invention will be described with reference to the drawings.

Figure 6:
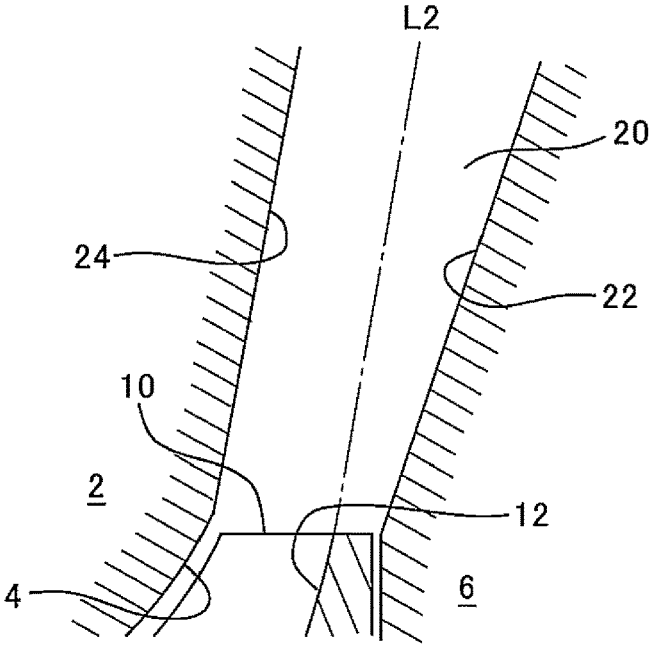
FIG. 6 is a longitudinal cross-sectional view showing essential parts of a vaneless diffuser configured according to an embodiment 3.

FIG. 6 is a longitudinal cross-sectional view showing essential parts of the vaneless diffuser configured according to the embodiment 3 of the present invention. In this embodiment, in the longitudinal cross section including the rotational axis of the impeller 10, the hub-side wall 22 of the vaneless diffuser 20 is formed to be inclined to the opposite side to the shroud-side wall 24 with respect to the tangential line L2 to the surface of the outlet of the hub 12. On the other hand, in the longitudinal cross section including the rotational axis of the impeller 10, the shroud-side wall 24 is formed to be in parallel with the direction of the tangential line L2 to the surface of the outlet of the hub 12. Therefore, the distance between the shroud-side wall 24 and the hub-side wall 22 gradually increases from the inlet to the outlet of the vaneless diffuser 20. With the configuration of the vaneless diffuser limited according to this embodiment, the possibility that the oil mist collides with and adheres to the hub-side wall 22 can be decreased, as with the configurations according to the embodiments 1 and 2.

Embodiment 4

Next, an embodiment 4 of the present invention will be described with reference to the drawings.

Figure 7:
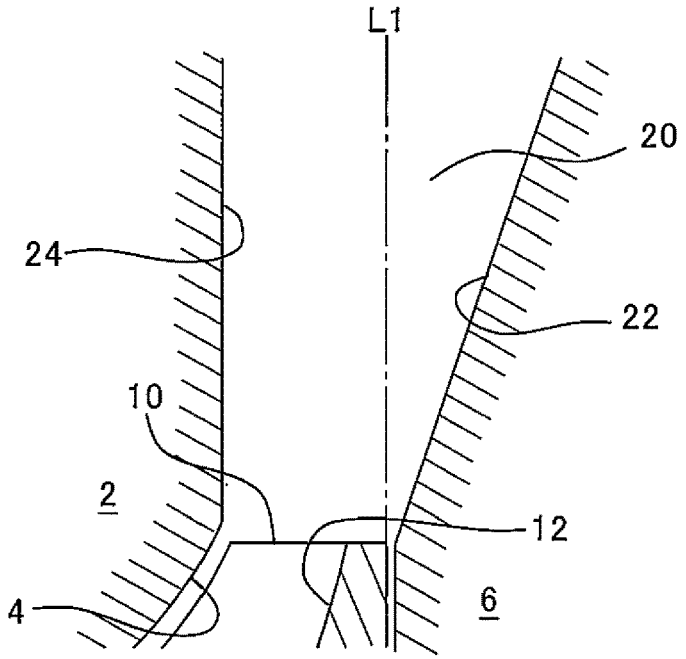
FIG. 7 is a longitudinal cross-sectional view showing essential parts of a vaneless diffuser configured according to an embodiment 4.

FIG. 7 is a longitudinal cross-sectional view showing essential parts of the vaneless diffuser configured according to the embodiment 4 of the present invention. In this embodiment, in the longitudinal cross section including the rotational axis of the impeller 10, the hub-side wall 22 of the vaneless diffuser 20 is formed to be inclined to the opposite side to the shroud-side wall 24 with respect to the line L1 perpendicular to the rotational axis of the impeller 10. On the other hand, in the longitudinal cross section including the rotational axis of the impeller 10, the shroud-side wall 24 is formed to be in parallel with the line L1 perpendicular to the rotational axis of the impeller 10. That is, the hub-side wall 22 is formed in the shape of a truncated conical surface, whereas the shroud-side wall 24 is formed by a flat surface perpendicular to the rotational axis of the impeller 10. Such a configuration can also decrease the possibility that the oil mist collides with and adheres to the hub-side wall 22, as with the configurations according to the embodiments 1 to 3.

Embodiment 5

Next, an embodiment 5 of the present invention will be described with reference to the drawings.

Figure 8:
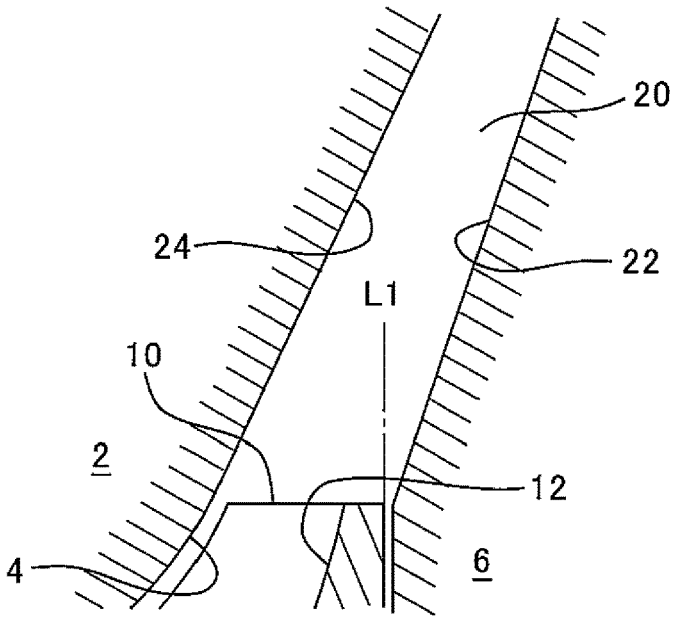
FIG. 8 is a longitudinal cross-sectional view showing essential parts of a vaneless diffuser configured according to an embodiment 5.

FIG. 8 is a longitudinal cross-sectional view showing essential parts of the vaneless diffuser configured according to the embodiment 5 of the present invention. In this embodiment, the hub-side wall 22 and the shroud-side wall 24 are formed to be inclined at different angles with respect to the line L1 perpendicular to the rotational axis of the impeller 10: the shroud-side wall 24 is inclined at a larger angle. Thus, the space between the shroud-side wall 24 and the hub-side wall 22 gradually becomes narrower as it goes from the inlet to the outlet of the vaneless diffuser 20. Such a configuration can also decrease the possibility that the oil mist collides with and adheres to the hub-side wall 22, as with the configurations according to the embodiments 1 to 4.

Embodiment 6

Next, an embodiment 6 of the present invention will be described with reference to the drawings.

Figure 9:
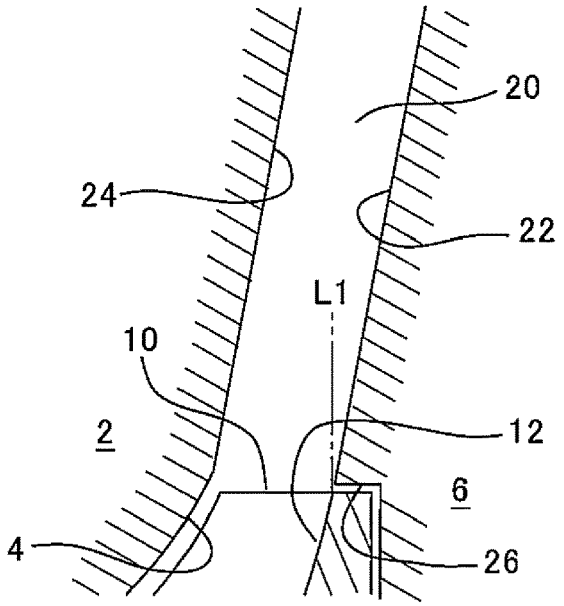
FIG. 9 is a longitudinal cross-sectional view showing essential parts of a vaneless diffuser configured according to an embodiment 6.

FIG. 9 is a longitudinal cross-sectional view showing essential parts of the vaneless diffuser configured according to the embodiment 6 of the present invention. In this embodiment, a cylindrical recess 26 is formed in the back plate 6. The recess 26 has a slightly larger outer diameter than the hub 12 of the impeller 10, and the hub 12 is housed in the recess 26. As a result, the step between the surface of the hub 12 and the hub-side wall 22 of the vaneless diffuser 20 is eliminated, and the surface of the hub 12 is seamlessly connected to the hub-side wall 22. As far as the hub-side wall 22 is formed to be inclined to the opposite side to the shroud-side wall 24 with respect to the line L1 perpendicular to the rotational axis of the impeller 10, such a configuration can also decrease the possibility that the oil mist collides with and adheres to the hub-side wall 22. The configuration limited by this embodiment can be combined with the configuration of the vaneless diffuser limited by any of the embodiments 1 to 5.

Embodiment 7

Next, an embodiment 7 of the present invention will be described with reference to the drawings.

Figure 10:
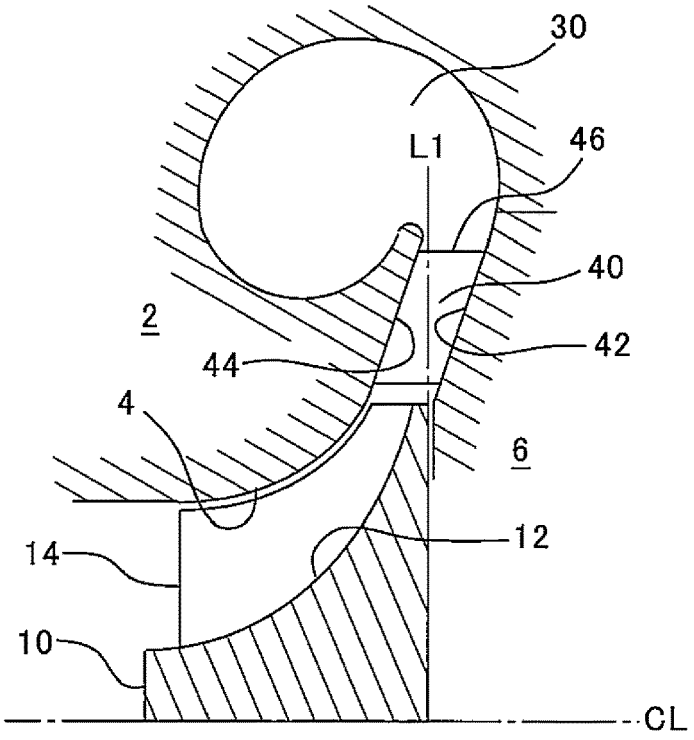
FIG. 10 is a longitudinal cross-sectional view showing a configuration of a compressor for a supercharger of an internal combustion engine according to an embodiment 7 of the present invention.

FIG. 10 is a longitudinal cross-sectional view showing a configuration of a compressor for a supercharger of an internal combustion engine according to the embodiment 7 of the present invention. Of the components of the compressor according to this embodiment shown in FIG. 10, the same components as those of the compressor according to the embodiment 1 shown in FIG. 1 are denoted by the same reference numerals. The compressor according to this embodiment is provided with a vane diffuser 40, while the compressor according to the embodiment 1 is provided with the vaneless diffuser 20. The vane diffuser 40 is formed by a shroud-side wall 44, which is a part of the housing 2, a hub-side wall 42, which is a part of the back plate 6, and a plurality of vanes 46 disposed between the shroud-side wall 44 and the hub-side wall 42. The vanes 46 are attached to either of the shroud-side wall 44 and the hub-side wall 42.

In this embodiment, in the longitudinal cross section including the rotational axis CL of the impeller 10, the hub-side wall 42 of the vane diffuser 40 is formed to be inclined toward the opposite side to the shroud-side wall 44 with respect to the line L1 that is perpendicular to the rotational axis CL of the impeller 10. In the longitudinal cross section including the rotational axis CL of the impeller 10, the shroud-side wall 44 is formed to be inclined toward the hub-side wall 42 with respect to the line L1 that is perpendicular to the rotational axis CL of the impeller 10. There is no limitation on the configuration of the vanes 46. The vanes 46 according to this embodiment may be fixed vanes provided at a fixed angle or variable vanes provided at a variable angle.

With the hub-side wall 42 and the shroud-side wall 44 formed as described above, the vane diffuser 40 having the vanes 46 according to this embodiment can also decrease the possibility that the oil mist conveyed by the compressed air ejected from the impeller 10 collides with and adheres to the hub-side wall 22, and instead the oil mist collides with the shroud-side wall 44. Since oil flows to the shroud-side wall 44 along the surface of the shroud 4, the oil mist colliding with the shroud-side wall 44 is washed out by the oil. Therefore, even if the amount of oil mist colliding with the shroud-side wall 44 increases, no deposit grows on the shroud-side wall 44, or any deposit on the shroud-side wall 44 grows at a very slow rate. Therefore, with the configuration of the compressor according to this embodiment, the amount of deposit of the entire vane diffuser 40 can be reduced.

The relationships in inclination between the hub-side wall 22 and the shroud-side wall 24 limited in the embodiments 2, 3, 5 and 6 can be applied to the hub-side wall 42 and the shroud-side wall 44 according to this embodiment. The hub-side wall 42 and the shroud-side wall 44 preferably have the shape of a truncated conical surface.

Embodiment 8

Finally, an embodiment 8 of the present invention will be described with reference to the drawings.

Figure 11:
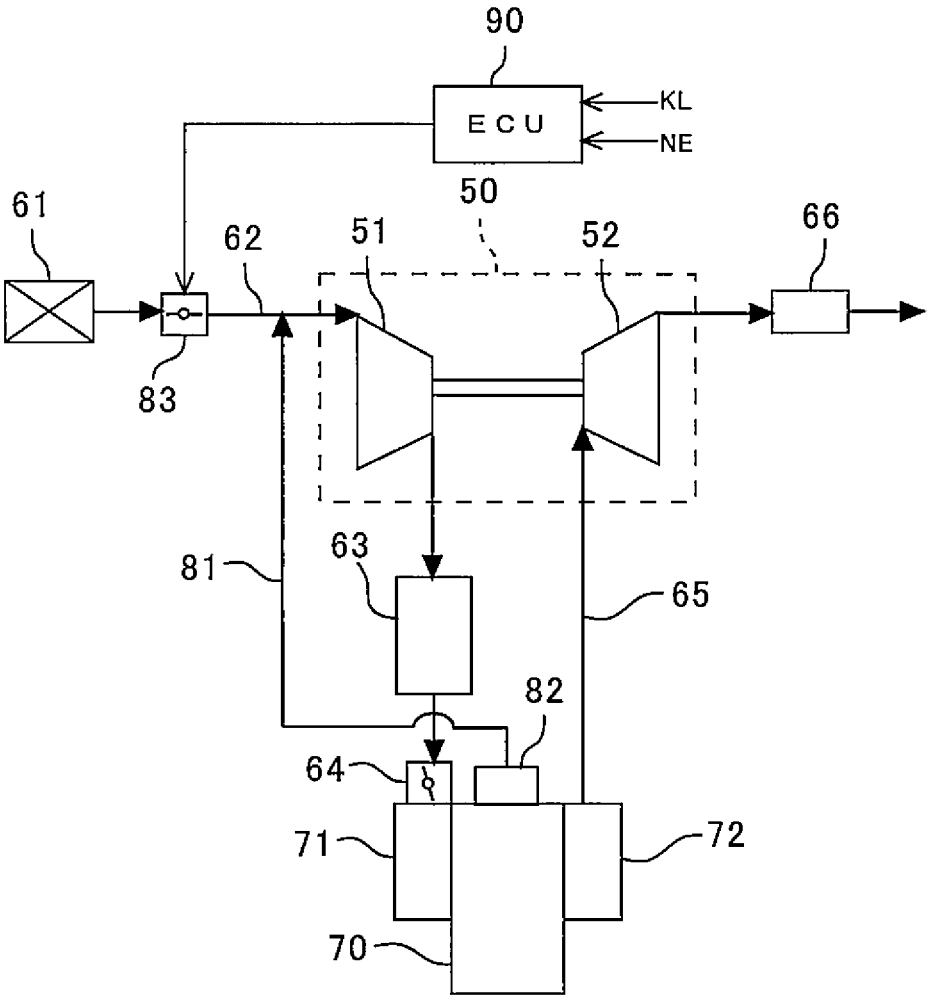
FIG. 11 is a diagram showing a configuration of an internal combustion engine according to an embodiment 8 of the present invention.

The compressor to which the present invention is applied is suitably used in an internal combustion engine shown in FIG. 11. The internal combustion engine according to this embodiment includes an engine main unit 70 configured as a diesel engine or a spark ignition engine. An intake manifold 71 and an exhaust manifold 72 are attached to the engine main unit 70. An intake channel 62, which introduces air taken in through an air cleaner 61 into the engine main unit 70, is connected to the intake manifold 71. A compressor 51 of a turbocharger 50 is attached to the intake channel 62. The compressor 51 is any of the compressors according to the embodiments 1 to 7. An intake air throttle valve 83 is attached to the intake channel 62 at a point upstream of the compressor 51. An intercooler 63 is provided in the intake channel 62 at a point downstream of the compressor 51, and a throttle valve 64 is attached to the intake channel 62 at a point downstream of the intercooler 63. An exhaust channel 65, which is provided with a catalyst device 66 and a muffler (not shown), is connected to the exhaust manifold 72. A turbine 52 of the turbocharger 50 is attached to the exhaust channel 65 at a point upstream of the catalyst device 66.

The internal combustion engine according to this embodiment is provided with a blow-by gas channel 81 that feeds blow-by gas leaking from a combustion chamber into a crankcase in the engine main unit 70 back to the intake channel 62. By the blow-by gas channel 81, a cylinder head of the engine main unit 70 and a part of the intake channel 62 upstream of the compressor 51 are in communication with each other. The blow-by gas channel 81 is provided with an oil separator 82 that collects and recovers the oil mist contained in the blow-by gas. However, some of the oil mist is not collected by the oil separator 82 and flows into the intake channel 62 with the blow-by gas. The oil mist flowing into the intake channel 62 flows into the compressor 51 with air.

Although the oil mist flowing into the compressor 51 causes deposit, the amount of deposit is small because the compressor 51 is any of the compressors according to the embodiments 1 to 7. If the high-load high-rotation operation in which the temperature in the compressor 51 rises continues, however, the probability of deposit formation in the compressor 51 increases. In this embodiment, engine control is conducted to reliably prevent deposit formation under such conditions.

The engine control involves increasing the flow rate of the blow-by gas fed from the blow-by gas channel 81 back to the intake channel 62. If the flow rate of the blow-by gas increases, the amount of oil mist contained in the blow-by gas and flowing into the intake channel 62 also increases. Although oil mist in the form of small droplets causes deposit, a large amount of oil mist in the form of larger drops has a significant effect of washing out deposit. By increasing the amount of blow-by gas and introducing a large amount of oil mist into the compressor 51, deposit formation in the compressor 51 can be prevented with reliability.

In this embodiment, the intake air throttle valve 83 is used as means of increasing the flow rate of blow-by gas. If the opening degree of the intake air throttle valve 83 is adjusted to the closing side, the negative pressure exerted on the intake channel 62 at a point upstream of the compressor 51 increases, and the flow rate of the blow-by gas introduced from the blow-by gas channel 81 into the intake channel 62 increases. Control of the intake air throttle valve 83 is conducted by an ECU 90, which is a controller of the internal combustion engine.

Figure 12:
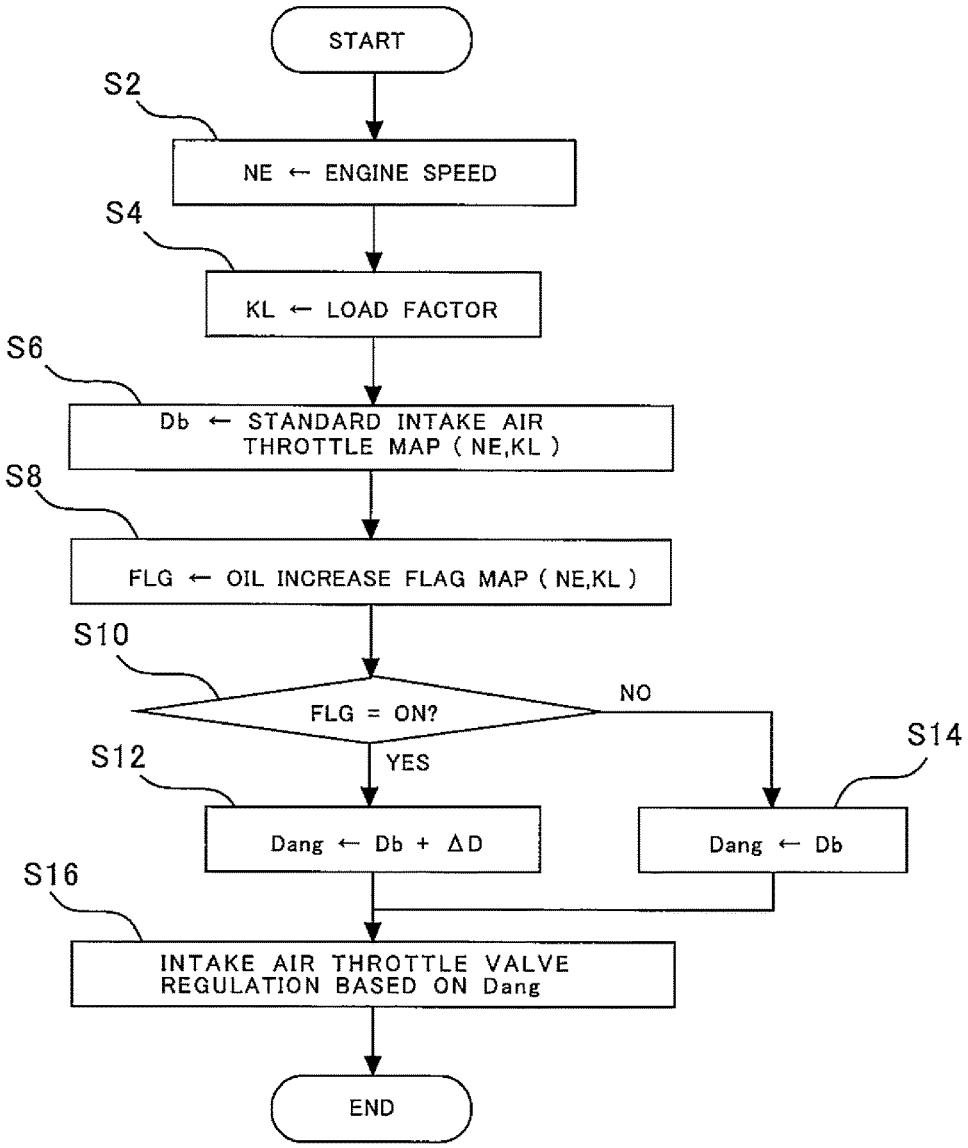
FIG. 12 is a flowchart showing a control routine for an intake air throttle valve conducted in the embodiment 8 of the present invention.

FIG. 12 is a flowchart showing a control routine for the intake air throttle valve conducted by the ECU 90. The ECU 90 conducts the routine at a predetermined control cycle. In the first step S2, the ECU 90 receives the engine speed NE calculated from a signal from a crank angle sensor. In the following step S4, the ECU 90 receives the load factor KL calculated from the fuel injection amount. In the following step S6, the ECU 90 determines the basic opening degree Db of the intake air throttle valve 83 from the engine speed NE and the load factor KL using a standard intake air throttle map. The standard intake air throttle map is a map of the opening degree of the intake air throttle valve 83 determined by the engine speed and the load factor from the viewpoint of fuel consumption or other performance.

Figure 13:
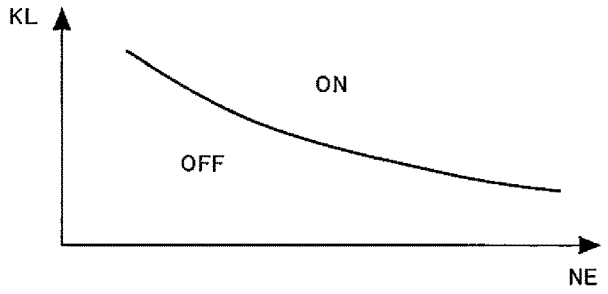
FIG. 13 is a diagram showing an image of an oil increase flag map used in the routine shown in FIG. 12.
Figure 14:
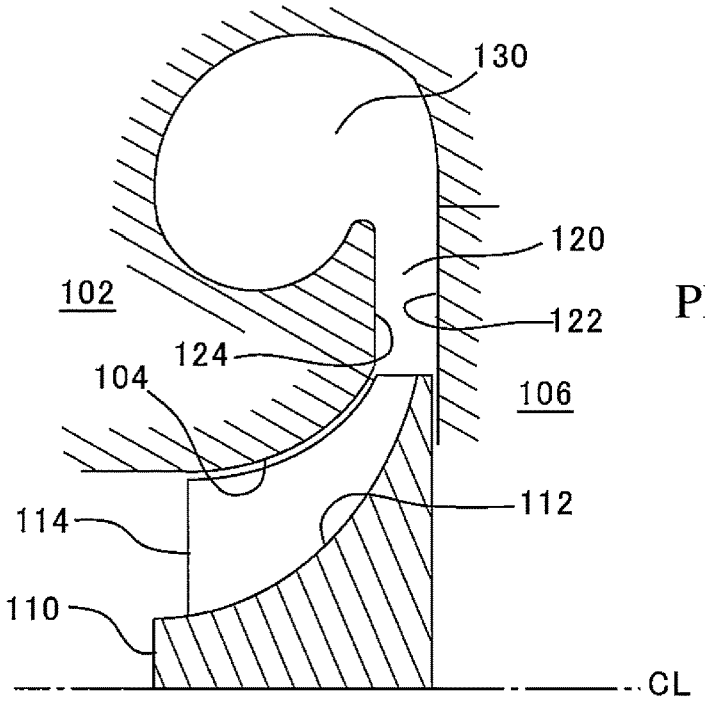
PRIOR ART Fig.14
FIG. 14 is a longitudinal cross-sectional view showing a configuration of a conventional compressor for a supercharger of an internal combustion engine.
Figure 15:
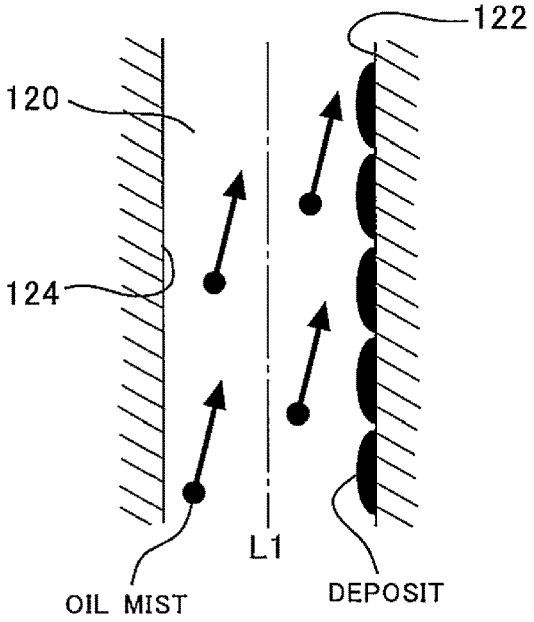
PRIOR ART Fig.15
FIG. 15 is a diagram for illustrating a flow of oil mist in a diffuser of the conventional compressor.

Furthermore, in the step S8, the ECU 90 determines the value of the flag FLG, which determines whether to increase the amount of blow-by gas or not, by inserting the values of the engine speed NE and the load factor KL into an oil increase flag map. FIG. 13 is a graph showing an image of the oil increase flag map. In the graph shown in FIG. 13, whose axes represent the engine speed NE and the load factor KL, the flag FLG is set ON (the value of the flag FLG is set at 1) in the region on the higher load and higher rotation side than the curve in the graph, and is set OFF (the value of the flag FLG is set at 0) in the region on the lower load and lower rotation side than the curve.

In the step S10, the ECU 90 determines whether the flag FLG is set ON or not, and determines the opening degree of the intake air throttle valve 83 based on the result of the determination. If the flag FLG is ON, the processing by the ECU 90 proceeds to the step 512. In the step S12, the sum of the basic opening degree Db and a correction value ΔD is determined as a command opening degree Dang to be transmitted to the intake air throttle valve 83. On the other hand, if the flag FLG is OFF, the processing by the ECU 90 proceeds to the step S14. In the step S14, the basic opening degree Db is used as the command opening degree Dang to be transmitted to the intake air throttle valve 83.

In the step S16, the ECU 90 regulates the intake air throttle valve 83 based on the command opening degree Dang determined in the step S12 or S14. The intake air throttle valve 83 is fully opened when the command opening degree Dang is 0, and the opening degree of the intake air throttle valve 83 decreases as the value of the command opening degree Dang increases. Thus, if the processing of the step S12 is selected, the opening of the intake air throttle valve 83 is narrower than normal, and therefore the negative pressure increases and the flow rate of the blow-by gas increases. On the other hand, if the processing of the step S14 is selected, the intake air throttle valve 83 is regulated to have a normal opening degree.

Others

The present invention is not limited to the embodiments described above, and various modifications can be made without departing from the spirit of the present invention. For example, while the hub-side wall of the diffuser in the embodiments described above has the shape of a truncated conical surface, the shape of the hub-side wall is not necessarily limited to that shape. The hub-side wall can be partially or wholly curved as far as the hub-side wall is inclined as a whole to the opposite side to the shroud-side wall with respect to the direction perpendicular to the rotational axis of the impeller in the longitudinal cross section including the rotational axis of the impeller. Alternatively, the hub-side wall may be formed by a combination of a plurality of truncated conical surfaces that are inclined at different angles. The same holds true for the shroud-side wall.

REFERENCE SIGNS LIST

2 housing
4 shroud
6 back plate
10 impeller
12 hub
14 blade
20 vaneless diffuser
22 hub-side wall
24 shroud-side wall
30 scroll
40 vane diffuser
42 hub-side wall
44 shroud-side wall
46 vane

The invention claimed is:

1. A compressor for a supercharger of an internal combustion engine, comprising:

a shroud formed inside a housing;

an impeller having a hub rotatably disposed in the shroud and a plurality of blades attached to a surface of the hub, the surface comprising intersections with each of the blades and the hub;

an annular vaneless diffuser that surrounds a periphery of the impeller; and a spiral scroll that surrounds a periphery of the vaneless diffuser, wherein the entire shroud-side wall and the entire hub-side wall of the vaneless diffuser are formed to be inclined in a direction toward the hub-side wall with respect to a direction perpendicular to the rotational axis of the impeller, and the entire shroud-side wall and the entire hub-side wall of the vaneless diffuser are formed to be inclined with respect to a line tangent to the surface at an outlet point of the hub.

2. The compressor for a supercharger of an internal combustion engine according to claim 1, wherein the hub-side wall of the vaneless diffuser is formed to have the shape of a truncated conical surface.

3. The compressor for a supercharger of an internal combustion engine according to claim 1, wherein the shroud-side wall of the vaneless diffuser is formed to be in parallel with a direction of the flow of oil mist ejected from the impeller.

4. The compressor for a supercharger of an internal combustion engine according to claim 1, wherein the shroud-side wall of the vaneless diffuser is formed to have the shape of a truncated conical surface.

* * * * *